US005628235A

United States Patent [19]

Kambara

[11] Patent Number: 5,628,235

[45] Date of Patent: May 13, 1997

[54] DRIVING ATTACHMENT FOR EYE-BOLT HANGERS AND THE LIKE

[76] Inventor: Goro Kambara, 13730 Via Encantado, Valley Center, Calif. 92082

[21] Appl. No.: 526,835

[22] Filed: Sep. 12, 1995

[51] Int. Cl.[6] ..... B25B 13/28

[52] U.S. Cl. ..... 81/90.2; 81/91.3; 81/373; 81/901

[58] Field of Search ..... 81/90.1, 90.2, 81/90.4, 90.6, 90.9, 91.3, 373, 901

[56] References Cited

U.S. PATENT DOCUMENTS 3,910,140 10/1975 Rose ..... 81/91.3 X 4,438,668 3/1984 Solomon ..... 81/373 X

*Primary Examiner*—James G. Smith

[57] ABSTRACT

A pair of jaws, having two sets of mutually perpendicular surfaces which are oriented 45 degrees with respect to the direction of jaw motion. During adjustment the jaws move parallel to each other to accommodate different shank diameters. The opening and closing of the jaws for receiving and clamping a shank is accomplished by an overcenter toggle assembly that produces a combination of parallel and rotational motion which secures the shank against the two mutually orthogonal surfaces of the jaw.

6 Claims, 2 Drawing Sheets

DRIVING ATTACHMENT FOR EYE-BOLT HANGERS AND THE LIKE

BACKGROUND

1. Field of the Invention

This invention relates to a portable drill attachment, specifically all attachment which can be used to drive eye-bolts, J-bolts, screw hooks, and other hanger-type devices which cannot be "chucked" because of their physical configuration.

2. Discussion of Prior Art

Eye bolts with lag threads are commonly used to hang loads from overhead locations such as beams and ceilings as well as walls, trees and other structures. po In the usual procedure, the worker will either hammer the eye-bolt into the material (typically wood) to grab a few threads, or he will pre-drill a pilot hole; in either case the threaded shank is thereafter manually screwed into the material using pliers or some other leverage effecting device. The procedure is both cumbersome and time consuming—and generally requires several different tools. Moreover, unless a pilot hole is drilled, the starting process can be frustrating and difficult since hammering is likely to deform the end (in the case of eye-bolts, the eye is deformed whereas off axis hangers such as J-bolts and square bent hooks are difficult to hammer and more likely therefore to become damaged or distorted).

The desirability of a device which is sufficiently universal to accommodate a wide range of hanger types and sizes so as to facilitate their rapid installation will be readily appreciated. Accordingly, it is a primary object of the invention to provide a driving attachment for a portable drill which can be used efficaciously for a wide range of hanger types and sizes, including but not limited to:

(a) shank diameters ranging from 1/16" to 7/16"

(b) head dimensions ranging from 1/8" to 1¼"

(c) head configurations including round, L, J, offset round, square, and combinations thereof.

It will be understood that to accomplish these objectives with a single device, the invention must effectively meet and resolve numerous difficulties, thus (a) for different shank diameters,
  1) the torque must be axially centered by the gripping elements and,
  2) the shank neck must be mechanically restrained so as to maintain the thrust axis alignment.

(b) for different head dimensions, the point of application of the axial force must be centered with the torque axis.

(c) for different head configurations, the point of application of the axial force must line up with the torque axis.

OBJECTS AND ADVANTAGES

Accordingly, other objects and advantages of the invention are:

(a) to provide an attachment for installing eye-bolts, J-bolts, screw hooks, and the like, using a manual or power drill.

(b) to provide a driver that eliminates the need to hammer a starting indentation or the need to drill a pilot hole.

(c) to provide a driver that has universal applicability so as to cover a wide range of shank sizes, eye diameters, and end shapes.

(d) to provide a driver that aligns the screw axis true to the torque axis for all shank sizes and hanger shapes.

Further objects and advantages of the invention are to provide a driver that shortens the installation time and eliminates the fatigue involved in manual installation. Other objects and advantages will become apparent from a consideration of the ensuing description and drawings.

SUMMARY OF THE INVENTION

A pair of parallel linkage assemblies can be used to maintain the parallel orientation of separately adjustable jaws. Each jaw includes a pair of mutually orthogonal surfaces which function to secure different shank sizes when they are brought together by actuation of an overcenter toggle. The assembly permits a wide variety of hanger shapes and sizes to be installed using a portable electric drill.

REFERENCE NUMERALS IN DRAWINGS

| | | | |
|---|---|---|---|
| 10A | left jaw | 10B | right jaw |
| 12A | neck locating surface, left jaw | 12B | neck locating surface, right jaw |
| 14A | gripping surface, left jaw | 14B | gripping surface, right jaw |
| 20 | left bifilar assembly | 21 | linkage |
| 22 | left linkage | 22' | right linkage |
| 23 | linkage | 24 | linkage |
| 26 | left diagonal adjustment member | 26' | right diagonal adjustment member |
| 27 | thumb screw | 27' | right thumb screw |
| 28 | left adjustment slot | 28' | right adjustment slot |
| 29 | threaded hole | | |
| 30 | toggle clamp | 32 | linkage |
| 34 | linkage | 36 | linkage |
| 38 | left linkage | 38' | right linkage |
| 40 | toggle clamp, closure | 42 | closure pin |
| 44 | lever | 46 | closure linkage |
| 50 | body | 52 | shank portion of shaft |
| 54 | slot | 56 | slot |
| 61 | pin | 61' | pin |
| 62 | pin | 62' | pin |
| 63 | pin | 63' | pin |
| 64 | pin | 65 | pin |
| 72 | retaining ring | 74 | spacer |
| 76 | torsion spring | 78 | eye-bolt |

DETAILED DESCRIPTION OF A PREFERRED EMBODIMENT

Figure 1:
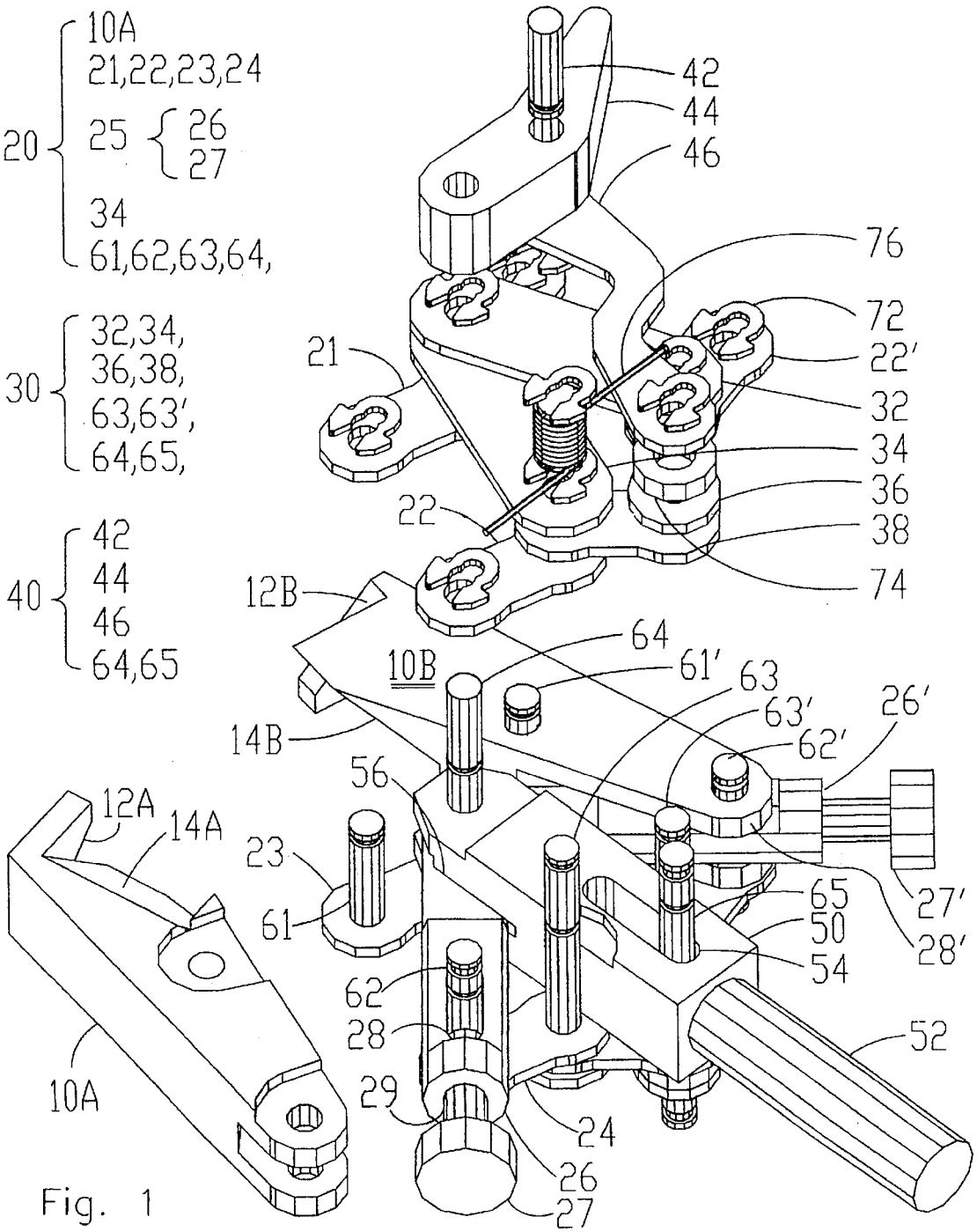
FIG. 1 is an exploded view of the driver attachment.

Referring to the drawings, and particularly FIG. 1, there is shown a pair of jaws comprising a left jaw clement 10A and a right jaw element 10B, each of which is constructed to have left and right complimentary surfaces 12A and 12B for gripping a hanger shaft, and left and right hand clamping surfaces 14A and 14B for retaining the location of the hanger in position when axial thrust is applied. In order to facilitate the gripping of a wide range of shaft sizes, the jaws 10A and 10B must maintain the parallel orientation of these surfaces (12A parallel with 12B) and (14A parallel with 14B) as they move inwardly to engage the shaft. This function is achieved by two separate bifilar configurations, namely a left parallel linkage assembly 20, the motion of which is determined by the location of pins 61, 62, 63 and 64 which define the spatial orientation of the left jaw 10A as it moves toward the right jaw 10B which itself moves parallel to jaw 10A by virtue of the right parallel linkage assembly, its motion being in a like manner determined by the location of pins 61', 62', 63' and 64'.

Figure 2:
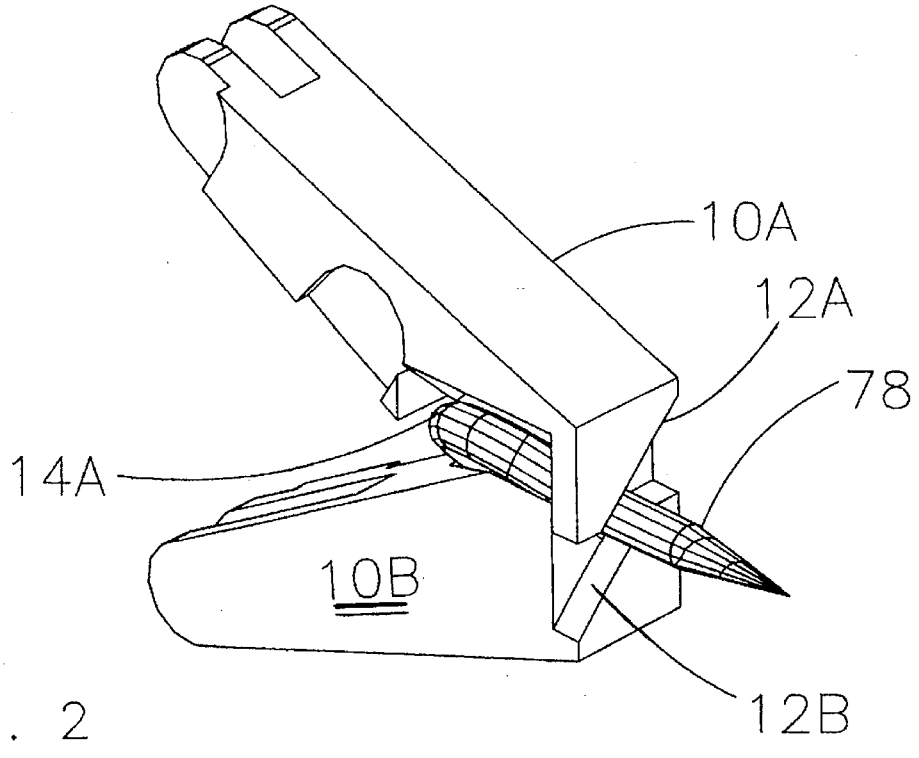
FIG. 2 is a perspective view illustrating the mechanical interaction involved in simultaneously gripping and centering
Figure 3:
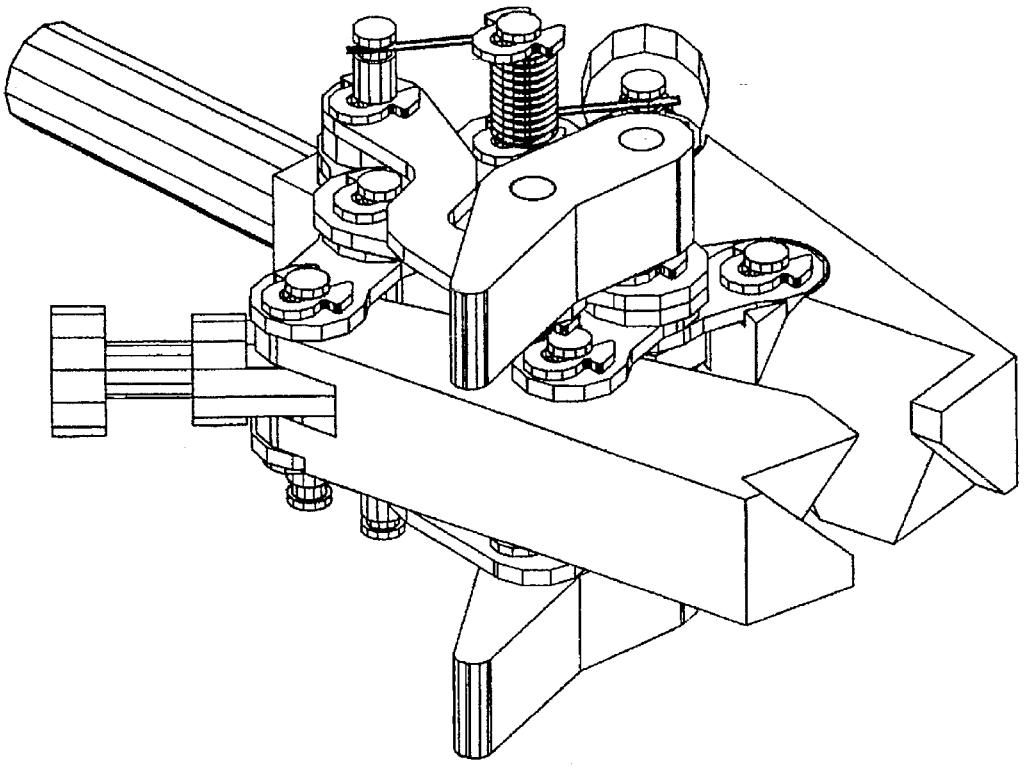
FIG. 3 is a perspective view of the assembled driver.

The left parallel linkage assembly 20 is comprised of four linkages 21, 22, 23 and 24, jaw 10A, linkage 34, and pins 61, 62, 63 and 64. The right parallel linkage assembly is comprised of complimentary mirror image elements which function identical to the left parallel linkage elements. Both the left and right parallel linkage assemblies include an adjustment feature which functions to change the diagonal distance of travel of the jaws 10A and 10B to accommodate various shank diameters. The left jaw adjustment assembly is comprised of thumb screw 27, and an adjustment member 26 which pivots about pin 64 at the end of body 50 through the slot 56. Member 26 has a slot 28 of sufficient width to accommodate post 62. Advancing thumb screw 27 into the threaded hole 29 of adjustment member 26 shortens the diagonal distance between pin 64 and pin 62 thus moving jaw 10A in the direction of closure. An identical set of mirror image elements allow jaw 10B to be likewise adjusted with respect to pin 62'—in essence, the location of pins 62 and 62' within the slots 28 and 28' of members 26 and 26"respectively determine the spacing between the jaws 10A and 10B prior to clamp down. The two surfaces 12A and 12B are parallel to each other as are the surfaces 14A and 14B. Preferable these complementation pairs of surfaces are perpendicular to each other so as to optimize the retention force when the jaws 10A and 10B are brought together so that these pairs of surfaces can forcefully engage a hanger shaft as shown in FIG. 2.

To recapitulate, the parallelogram type motion of the jaws is produced by the motion of the linkages and pins. Specifically, for the left jaw 10A the forward linkages 21 and 23 of the left parallel linkage assembly 20 rotate about pin 64 over and under the body 50 respectively while the rear linkages 22 and 24 rotate through the same angle about pin 63, over and under the body 50 respectively. A similar corresponding motion of the right jaw 10B is produced by the right parallel linkage components.

As seen from FIG. 1, the linkages 32, 34, 36, 38 together with pins 63, 63', 64, 65 form an over-center toggle clamp 30 which is more particularly described as follows:

"Linkages 32 and 34 pivot about pin 64 so as to move outwardly by virtue of linkages 36 and 38 when pin 65 is pulled forward in slot 54 by a torque action against lever 44 which rotates about pin 64. Pin 42 engages closure linkage 46 which communicates the torque applied to lever 44 via pin 65 to linkages 32 and 34 so as to cause the combination of linkages (i.e., 38–22) and (36–22') to move pins 63 and 63' outwardly. As a consequence the torque applied to the lever 44 is converted to a clamping force between the surfaces 12A and 12B when the left and right bifilar assemblies have been pre-adjusted by thumb screws 27 and 27' to accommodate a particular shaft diameter. It will be understood that the action of toggle clamp 40 is such as to cause pin 65 to slide in slot 54 of body 50 so that both the left and right assemblies remain symmetrically disposed to one another at all times. Closure of toggle damp assembly 40 is thus effectuated via closure pin 42, lever 44, closure linkage 46, pin 65 being pulled toward pin 64 within slot 54 as lever 44 is manually rotated about pin 64 until pin 42 has rotated to a point slightly beyond the center line connecting pins 65 and 64 in order to overcenter lock the apparatus until a manual torque is applied against lever 44 in the opposite direction."

Retaining rings or keepers (i.e., 72) are used throughout to hold the assembly together. Spacer 74 occupies the gap which exists between linkage 36 and closure linkage 46. Torsion spring 76 wraps around the extended portion of pin 63, and end of spring 76 being arranged to push upon the extended portion of pin 62 to bias the parallel linkage assembly toward the open parallelogram position. The other end of spring 76 pushes against the extended portion of pin 65 so as to urge toggle damp assembly 30 toward the open jaw position, these biases having a tendency to make the adjustment and loading easier.

From the description above, a number of advantages are readily apparent:

(a) the device is universally functional, and can be used with any standard manual or power drill.

(b) the invention eliminates the need to pound or drill a starting hole.

(c) the device can be made in different sizes—to cover a vast variety of hangers.

(d) the assembly will drive the screw axis true to the driving axis regardless of the shank diameters or hanger configuration.

OPERATION

Adverting again to FIG. 1, the typical procedure for using the invention would involve the steps of inserting the drive shaft 52 in a conventional portable drill chuck (not shown). The shank portion of the hanger is then positioned between jaws and the two thumb screws 27 and 27' adjusted equally so that the two jaws 10A and 10B will center the hanger screw axis in line with the rotational axis of shaft 52 when lever 44 is operated to close. Once this pre-adjustment is made, lever 44 can be rotated to secure the shank; thereafter, for a given size shank, no further adjustments are necessary. FIG. 2 shows the position of the jaws 10A and 10B as they would appear after lever 44 is moved so as to lock the shank of the eye-bolt 78.

SCOPE

The apparatus disclosed herein is versatile and convenient. It eliminates the need to hammer start (or drill holes) and it eliminates the time intensive task of manual installation.

Although the description above contains many specificities, these should not be construed as limiting the scope of the invention but merely as descriptive of a preferred embodiment. For example, lever 44 can pivot from pin 65 capturing pin 63 at mid point then extend outward instead of closer to toggle clamp 30; shank portion of drive shaft 52 can be hexagonal instead of round; two separate compression springs, one in adjuster diagonal 26 to push against pin 62, the other in body 50 pushing against pin 65 to do the same work as torsion spring 76, etc. Thus the scope of the invention should be determined by the appended claims and their legal equivalents, rather than by the example given.

What is claimed is:

1. An apparatus for installing hangers comprising:

a body;

a 1st jaw;

a 1st parallel linkage assembly connecting said 1st jaw to said body; a 2nd jaw;

a 2nd parallel linkage assembly connecting said 2nd jaw to said body;

means for adjusting the position of said 1st and 2nd parallel linkage assemblies so as to cause said 1st and 2nd jaws to move parallel, each to the other, when either of said parallel linkage assemblies is adjusted;

a drive shaft connected to said body, said drive shaft being adapted to permit its insertion into a portable drill chuck;

toggle means for dosing said 1st and 2nd jaws so as to secure a hanger shaft in coaxial alignment with the rotational axis of said drive shaft;

and wherein said 1st and 2nd jaws each comprises a pair of mirror image mutually perpendicular surfaces, and wherein the corresponding mutually perpendicular surfaces on said 1st jaw are parallel to the corresponding mutually perpendicular surfaces on said 2nd jaw, and wherein each surface of said 1st jaw functions in cooperation with a corresponding surface of said 2nd jaw as a means for retaining a hanger shank when said 1st and 2nd jaws are adjusted to bring said mutually perpendicular surfaces into contact with a hanger shank.

2. An apparatus for installing hangers comprising:

a body having a drive shaft adapted to engage with a rotating power source;

a pair of jaws; p1 parallel linkage means for attaching said pair of jaws to said body so as to permit either of said jaws to be moved in a direction so as to maintain its orientation invariant with respect to the axis of rotation of said drive shaft;

locking means for causing said pair of jaws to engage a hanger shaft so as to coaxially align the hanger shaft with the axis of rotation of said drive shaft;

and wherein each jaw of said pair of jaws is constructed to have at least two mutually perpendicular surfaces, and wherein the mutually perpendicular surfaces of one jaw are parallel to the corresponding mutually perpendicular surfaces of the other jaw;

and wherein is included:

adjustment means for positioning each jaw of said pair of jaws so as to bring both jaws into contact with the shank of a hanger whereby said mutually perpendicular surfaces of said jaws function to center the axis of the hanger shank in coaxial alignment with the rotational axis of said drive shaft.

3. An apparatus for installing hangers of the type having a lag screw shank which is bent to produce a head configuration which extends beyond the shank diameter comprising:

at least one jaw means for engaging some 1st portion of a hanger shank;

2nd jaw means for engaging some 2nd portion of the hanger shank, and wherein at least one of said 1st and 2nd jaw means are adapted to accommodate the hanger head configuration when said 1st and 2nd jaw means are positioned so that each engages some portion of the hanger shank;

and further including drive shaft means positioned and oriented for rotating the hanger shank about its geometric screw axis when said 1st and 2nd jaw means are positioned to engage the hanger shank.

4. The apparatus recited in claim 3 wherein is included means for moving at least one jaw means comprising:

parallel linkage means for attaching a selected one of said jaw means to said drive shaft means so as to position said selected jaw means parallel to the axis of rotation of said drive shaft means whereby said selected jaw means will retain its parallel orientation with respect to the axis of rotation of said drive shaft means when said selected jaw means is moved to engage some portion of the hanger shank.

5. The apparatus recited in claim 4 wherein is included positioning means for locating the hanger shaft coaxially with the axis of rotation of said drive shaft means when said selected jaw means is moved to engage some portion of the hanger shank.

6. The apparatus recited in claim 5 wherein is included:

locking means for holding said 1st and 2nd jaw means in pressure contact with the hanger shaft so as to retain the hanger shaft in coaxial alignment with said drive shaft means when said drive shaft means is rotated.

* * * * *